US009033302B2

(12) United States Patent
Long, Sr.

(10) Patent No.: US 9,033,302 B2
(45) Date of Patent: May 19, 2015

(54) TAPER-ENDED FORM TIE

(75) Inventor: Robert T. Long, Sr., Ames, IA (US)

(73) Assignee: Composite Technologies Corporation, Boone, IA (US)

( * ) Notice: Subject to any disclaimer, the term of this patent is extended or adjusted under 35 U.S.C. 154(b) by 0 days.

(21) Appl. No.: 13/566,268

(22) Filed: Aug. 3, 2012

(65) Prior Publication Data

US 2013/0032690 A1 Feb. 7, 2013

Related U.S. Application Data

(60) Provisional application No. 61/514,663, filed on Aug. 3, 2011.

(51) Int. Cl.
*E04G 17/075* (2006.01)
*E04G 17/06* (2006.01)

(52) U.S. Cl.
CPC .... *E04G 17/0754* (2013.01); *E04G 2017/0633* (2013.01); *E04G 17/06* (2013.01)

(58) Field of Classification Search
CPC ..... E04G 17/047; E04G 17/0754; E04G 17/0721; E04G 2017/062; E04G 2017/0633
USPC ..... 249/40, 41, 42, 43, 44, 45, 46, 47, 190, 249/191, 213, 214, 216, 217, 219.1; 24/279, 284; 403/393
See application file for complete search history.

(56) References Cited

U.S. PATENT DOCUMENTS

| | | | | | |
|---|---|---|---|---|---|
| 78,403 | A | * | 5/1868 | Truesdell | 403/341 |
| 1,004,574 | A | * | 10/1911 | Jones | 403/391 |
| 1,019,598 | A | * | 3/1912 | Clark | 425/438 |
| 1,056,576 | A | * | 3/1913 | Olson | 256/35 |
| 1,293,391 | A | * | 2/1919 | Ewing | 249/214 |
| 1,767,834 | A | * | 6/1930 | Carlson | 249/217 |
| 1,847,473 | A | * | 3/1932 | De Right | 140/118 |
| 2,193,078 | A | * | 3/1940 | Schenk | 72/306 |
| 2,218,099 | A | * | 10/1940 | Schenk | 249/214 |

(Continued)

FOREIGN PATENT DOCUMENTS

| | | |
|---|---|---|
| CA | 1013927 | 7/1977 |
| FR | 1192584 | 10/1959 |

(Continued)

OTHER PUBLICATIONS

RJD Industries, Inc. SuperTie Fiberglass Formtie Systems, Jan. 2008, 57 pages.

(Continued)

*Primary Examiner* — Michael Safavi
(74) *Attorney, Agent, or Firm* — Brick Gentry PC; Brian J. Laurenzo; Jessica L. Susie

(57) ABSTRACT

A form tie for use in constructing building components and structures, including but not limited to concrete walls, concrete sandwich walls, and concrete foundations is disclosed. The form tie includes a central body portion and two end portions. The two end portions each include a taper that decreases in width inwardly toward the center of the form tie. Also disclosed is a clamp device for releasably securing the form tie to a form assembly. The clamp device includes a tapered passageway that grips a taper of the end portions of the disclosed form tie. Also disclosed is a form assembly including a first form wall, second form wall, and at least one form tie and clamp device of the present invention.

14 Claims, 6 Drawing Sheets

(56) References Cited

U.S. PATENT DOCUMENTS

| | | | | | |
|---|---|---|---|---|---|
| 2,395,204 | A | * | 2/1946 | Symons | 24/569 |
| 2,887,758 | A | * | 5/1959 | Clark | 249/214 |
| 2,983,012 | A | * | 5/1961 | Madden | 403/393 |
| 3,129,995 | A | * | 4/1964 | Brown | 439/417 |
| 3,249,371 | A | * | 5/1966 | Peterman | 285/253 |
| 3,251,615 | A | * | 5/1966 | Short, III | 285/112 |
| 3,430,914 | A | * | 3/1969 | Nichols et al. | 249/217 |
| 3,734,453 | A | * | 5/1973 | Bailey | 249/213 |
| 3,746,297 | A | | 7/1973 | Daniels, Jr. | |
| 3,888,455 | A | * | 6/1975 | Mikus | 249/214 |
| 3,910,546 | A | * | 10/1975 | Connors | 249/40 |
| 3,933,332 | A | * | 1/1976 | Lovisa et al. | 249/42 |
| 4,234,156 | A | * | 11/1980 | Wepf | 249/40 |
| 4,362,423 | A | * | 12/1982 | Miles | 403/393 |
| 4,370,840 | A | * | 2/1983 | Bisbee et al. | 52/410 |
| 4,545,163 | A | * | 10/1985 | Asselin | 52/378 |
| 4,640,490 | A | * | 2/1987 | Wilson | 249/214 |
| 4,736,921 | A | * | 4/1988 | Zane et al. | 248/316.2 |
| 5,255,488 | A | * | 10/1993 | Johnson et al. | 52/741.1 |
| 5,497,592 | A | * | 3/1996 | Boeshart | 52/699 |
| 5,657,601 | A | * | 8/1997 | Bean et al. | 52/426 |
| 6,138,981 | A | * | 10/2000 | Keith et al. | 249/41 |
| 6,159,399 | A | * | 12/2000 | Schmid | 264/35 |
| 6,722,099 | B2 | * | 4/2004 | Gilbert et al. | 52/745.09 |
| 7,819,388 | B2 | | 10/2010 | McCallion | |
| 2009/0179135 | A1 | | 7/2009 | Amend | |

FOREIGN PATENT DOCUMENTS

| | | |
|---|---|---|
| FR | 2558904 | 8/1985 |
| WO | WO2007053027 | 5/2007 |

OTHER PUBLICATIONS

Notification of Transmittal of the International Search Report and the Written Opinion of the International Searching Authority or the Declaration for PCT/US2012/049500 filed on Aug. 3, 2012.

Notification Concerning Transmittal of International Preliminary Report on Patentability (Chapter 1 of the Patent Cooperation Treaty) for PCT/US2012/049500 flied on Aug. 3, 2012.

Williams Form Engineering Corp., Concrete Forming Hardware Systems No. 311u, 64 pages, Oct. 24, 2010.

* cited by examiner

TAPER-ENDED FORM TIE

CROSS-REFERENCE TO RELATED APPLICATIONS

This application claims priority from U.S. Provisional Application Ser. No. 61/514,663, filed Aug. 3, 2011, entitled TAPER ENDED FORM TIE MADE OF A COMPOSITE MATERIAL AND ASSOCIATED WALLS, the contents of which is hereby incorporated in its entirety by reference.

FIELD OF THE INVENTION

The present invention relates to form ties used in the creation of building components, such as concrete walls and foundations. More specifically, the present invention relates to a form tie made of a composite material having tapered ends and associated clamping devices. Additionally, the form tie may have one or more grooves for receiving seal rings and/or reinforcement rings along the body of the form tie. Furthermore, a form assembly is provided employing the disclosed taper-ended form tie.

BACKGROUND

For many years concrete walls or foundations have been produced by casting concrete between two form walls made of wood, aluminum, steel, or other materials. Form walls require a connection called a form tie to hold the form walls together. Traditionally, form ties have been made using metals that are corrosive and very conductive. Generally, the form ties are either left in place after the forms are removed and then broken off at the concrete surface or removed from the wall. In the circumstance where the ties are removed, the form ties must first be treated with a bond breaker, such as grease. When the form ties are removed from the wall, the bond breaker must also be removed and the remaining hole must be plugged with an expansive grout or some other material. One type of concrete wall, a concrete sandwich wall, includes a layer of insulation and two layers of concrete, termed concrete wythes, one on each side of the insulation. In the event the walls are insulated, it is also necessary to replace the insulation prior to plugging and waterproofing the holes left by removing form ties of the prior art.

Moreover, in the case of breaking the form ties off at the surface and leaving them in place, corrosion of the remaining form tie may occur when exposed to moisture. Once corrosion begins, swelling of the corrosion may damage the wall, especially during freeze/thaw cycling. This may ultimately cause a leak that will allow moisture to penetrate the wall. Additionally, corrosion of metal form ties may lead to staining of interior and exterior wall surfaces. Further, the metallic ties create conductive paths through which large amounts of energy may be lost within a heated structure. In the event that the wall is insulated, the conductive paths may significantly reduce the efficiency of the insulation system. Furthermore, ties that are broken off at the surface have traditionally had a relatively low tensile strength.

Accordingly, there is a need in the art for a form tie that is neither corrosive nor highly conductive, and may also remain in the finished product without causing corrosion or compromising the thermal integrity of the structure. Further, there is a need in the art for a form tie that eliminates the extra steps of removing the form tie and plugging the hole that is left behind, leading to increased efficiency in the building process. There is also a need in the art for a form tie that can be broken off at the surface of the building component, yet has a high tensile strength.

As discussed above, the form ties of the prior art are often made of metal, which is undesirable in the finished building product. The prior art also includes form ties made of a composite material, which are sometimes left in the resulting building component. The prior art composite form ties require elaborate clamp devices to hold the form ties in place and allow the assembly to carry the load of the wet concrete. Sometimes, these elaborate ties include screw threads and wedge assemblies that either weaken the ability of the form tie to carry the load of the concrete and/or allow concrete to penetrate the parts of the clamp device, which ruins the clamp device after only a few uses. Furthermore, the form ties and clamp devices of the prior art are not able to take advantage of the full strength capacity of prior art form ties, which leads to the need to use many form ties of the prior art in a structure. Factors contributing to the ability to take advantage of the strength capacity of the form tie include, but are not limited to, the surface area of the form tie that the clamp device grips, how the clamp device grips the form tie, and the length of the form tie. In some cases, the form ties of the prior art get their strength capacity from the attached clamp device. The lower strength capacity of these form ties of the prior art can lead to slippage and/or failure of the tie. Accordingly, there is a need in the art for a form tie and clamp device that take advantage of as much of the strength capacity of the form tie as possible, do not weaken the ability of the form tie to carry the necessary loads, can be used to construct taller walls than form ties of the prior art, can be used in fewer numbers than form ties of the prior art in a given structure, and that do not allow concrete to penetrate parts of the clamp device, resulting in a clamp device that may be reused much more than the clamp devices of the prior art.

SUMMARY

The present invention provides a taper-ended form tie for use in constructing building components, particularly concrete components, including but not limited to concrete walls, concrete sandwich walls, and foundations. Also included in the present invention is a clamp device for releasably securing the form tie in a form assembly and that allows for greater strength capacity than form ties of the prior art. A form assembly employing the form tie of the present invention is also provided. The provided form tie is made of a composite material, has high tensile and compressive capacities to withstand the forces from the fluid concrete, and is corrosion resistant. The disclosed inventions solve the problems in the art identified above.

The taper-ended form tie of the present invention includes a central body portion and two end portions. The two end portions each include a segment that tapers toward the center of the central body portion. The clamp device of the present invention includes a passageway that is similarly tapered, allowing the form tie and clamp device to fit tightly together in a form assembly. The tapered portions of the form tie provide gripping surfaces for the clamp devices. The angled, wedge-shaped design of the present invention creates a form tie with a greater compressive and tensile strength capacity to withstand the forces of fluid concrete as the concrete building component is formed. The unique design and shape of the form tie and clamp device of the present invention causes the grip of the clamp device onto the form tie to increase and tighten as load from placement of fluid concrete is applied. Unlike metal form ties of the prior art, the form tie of the present invention is made of a composite material that is non-corrosive and is not very thermally conductive. Accordingly, the form tie may remain in the finished structure without adversely affecting the structural, aesthetic, or thermal properties of the completed structure. Moreover, this eliminates the need to remove the form ties from the structure, making the building process more efficient. The taper-ended form tie is cut at the surface of the completed building component and may be left as is or finished in any way that the surrounding concrete is finished. The taper-ended tie of the present invention has a high tensile strength, even after it is cut at the surface of the building component. Furthermore, the taper-ended form tie of the present invention provides a means to seal out moisture, preferably in the form of seal rings that act as water stops. Also, the taper-ended form tie of the present invention provides reinforcement rings for anchoring the taper-ended form tie in the concrete building component.

The disclosed taper-ended form tie and clamp device provide for many reuses of the clamp device. Due to the complimentary taper of the form tie and clamp device, the form tie and clamp device fit together tightly and allow the clamp device to attach to the form tie without the need for complex spring loaded devices of the prior art, leading to a form assembly that is easier to assemble than those of the prior art. Another advantage of the backdraft taper design is that as load is applied, the clamp gets tighter. Furthermore, the form tie and clamp device of the present invention do not allow the soft concrete to interfere with any mechanical parts necessary to reuse the clamp device. The disclosed taper-ended form tie has a greater strength capacity than form ties of the prior art. Advantages of greater strength capacity include using fewer number of form ties for a given wall or use in taller wall construction where forces due to the plastic concrete are large. The provided form assembly is constructed of at least two form walls and at least one taper-ended form tie. Further, at least one clamp device may be attached to one or both ends of the form tie that protrude from the form walls. The disclosed form assembly may be customized to construct a number of concrete building components, including but not limited to concrete walls, concrete sandwich walls, and foundations.

DETAILED DESCRIPTION

The following is a detailed description of an embodiment of a form tie 100, clamp device 200, and form assembly 300 of the present invention. For ease of discussion and understanding, the following detailed description and illustrations often refer to the form tie 100, clamp device 200, and form assembly 300 for use with the construction of concrete sandwich walls. It should be appreciated that the form tie 100, clamp device 200, and form assembly 300 may also be used in other applications known now or in the future, including but not limited to other types of concrete walls and foundations.

Figure 1:
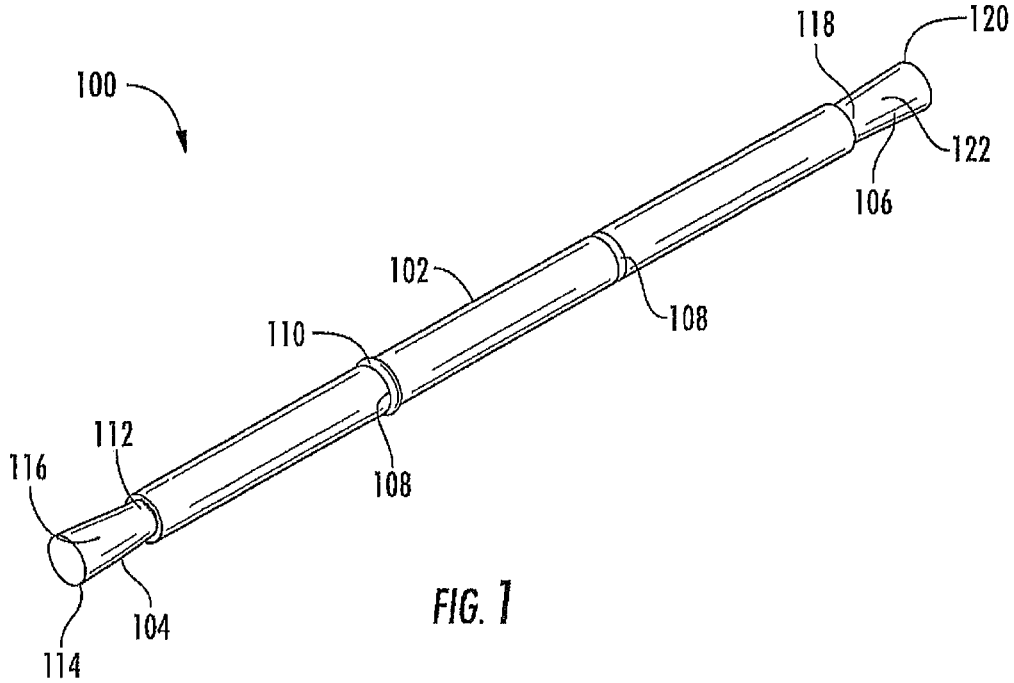
FIG. 1 is a perspective view according to one embodiment of a taper-ended form tie of the present invention.

Referring to FIG. 1, a taper-ended form tie 100 of the present invention is shown. The form tie includes an elongated body portion or central body portion 102, a first end portion 104 and a second end portion 106. As shown in FIG. 1, the first end portion 104 and second end portion 106 extend in opposite directions from the central body portion 102. The first end portion includes an outer end 114 and an inner end 112. Between the outer end 114 and inner end 112 is a first taper 116. Likewise, the second end portion 106 includes an outer end 120 and an inner end 118. Between the outer end 120 and inner end 118 is a second taper 122. The first taper 116 and second taper 122 angle inwardly from the outer ends 114, 120 of the form tie 100 to the center of the central body portion 102 and may also be referred to as backdrafts.

The central body portion 102 is generally of uniform diameter. The central body portion 102 of the preferred embodiment has a circular cross-section. However, one skilled in the art will recognize that the cross-section may be any shape, including but not limited to octagonal. In the preferred embodiment, the central body portion 102 includes two grooves 108, which will be described in greater detail later. Further, in the preferred embodiment, the cross-sectional width of the central body portion 102 ranges from 0.5-2.0 inches. However, as one skilled in the art will realize, the cross-sectional width of the central body portion 102 will vary from application to application and may be any width without departing from the scope of the present invention. The taper-ended form tie 100 is made of a composite material that is non-conductive, non-corrosive, and chemically resistant, such as the composite materials generally known in the art. The taper-ended form tie 100 has high tensile and compressive strength capacities. For example, in the preferred embodiment, the tensile strength capacity of the form tie 100 may exceed 120,000 pounds per square inch. The form tie 100 may be fabricated using any method known in the art now or in the future, including but not limited to machining or casting.

The first end portion 104 of the taper-ended form tie 100 includes an inner end 112 and an outer end 114. The inner end 112 is a first width and the outer end 114 is a second width. The second width is greater than the first width. Accordingly, the segment between the inner end 112 and outer end 114 forms a first taper 116 that decreases in dimension from the second width 114 to the first width 112. In the preferred embodiment, the entire first end portion 104 comprises the first taper 116. However, it should be understood that the first taper 116 may be located anywhere along the first end portion 104 and need not be located along the entire length of the first end portion 104. Rather, the first taper 116 may be located along any segment of the first end portion 104 that allows for the necessary strength capacity. The length of the first end portion 104 will vary depending on the application, but must be long enough to take advantage of the strength capacity of the form tie 100. In the preferred embodiment, the first end portion 104 is two inches long, but it may be any length without departing from the scope of the invention. Although the first end portion 104 of the illustrated embodiment is circular in cross section, the first end portion 104 may be any shape capable of taking advantage of the strength capacity of the form tie 100, as will be discussed below. Moreover, the cross-section of the first end portion 104 need not be the same shape as the central body portion 102.

The second end portion 106 includes an inner end 118 and an outer end 120. The inner end 118 is a first width and the outer end 120 is a second width. The second width is greater than the first width. Accordingly, the segment between the inner end 118 and outer end 120 forms a second taper 122 that decreases in dimension from the outer end 120 to the inner end 118. In the preferred embodiment, the entire second end portion 106 comprises the second taper 122. However, it should be understood that the second taper 122 may be located anywhere along the second end portion 106 and need not be located along the entire length of the second end portion 106. Rather, the second taper 122 may be located along any segment of the second end portion 106 that allows for the necessary strength capacity. The length of the second end portion 106 will vary depending on the application, but must be long enough to take advantage of the strength capacity of the form tie 100. In the preferred embodiment, the second end portion 106 is two inches long, but it may be any length without departing from the scope of the invention. Although the second end portion 106 of the illustrated embodiment is circular in cross section, the second end portion 106 may be any shape capable of taking advantage of the strength capacity of the form tie 100, as will be discussed below. Moreover, the cross-section of the second end portion 106 need not be the same shape as the central body portion 102.

In the preferred embodiment, the first taper 116 and second taper 122 uniformly angle inward toward the center of the central body portion 102 at an angle ranging from one to forty-five degrees, although any angle may be used without departing from the scope of the invention. More preferably the angles of the first taper 116 and second taper 122 are between four and seven degrees and are most preferably four degrees. As will be discussed herein below, the angled surfaces of the first taper 116 and second taper 122 develop or take advantage of the strength capacity of the taper-ended form tie 100. The angled surfaces provide a greater area for gripping by a clamp device, preferably the clamp device 200 disclosed herein. As one skilled in the art will recognize, the angles of the tapers 116, 122 will vary from application to application and may be any angles necessary to create the strength capacity needed for the application. In one embodiment, the first taper 116 and second taper 122 are one inch at the first end portion second width 114 and second end portion second width 120 and taper to three-fourths inch at the first end portion first width 112 and second end portion first width 118. Furthermore, although the preferred embodiment shown in the drawings and described herein includes a first taper 116 and second taper 122 of equal length and angle, one skilled in the art will realize that the length and angle of the two tapers 116, 122 need not be identical. Moreover, in the preferred embodiment, the cross-sectional dimensions of the central body portion 102, first end portion second width 114, and second end portion second width 120 are equal. However, one skilled in the art will recognize that the three measurements need not be equal. Moreover, the first taper 116 and second taper 122 need not taper uniformly toward the center of the central body portion 102. In an alternative embodiment, the taper-ended form tie 100 of the present invention may be adjustable.

Although the central body portion is generally uniform in diameter, in the preferred embodiment at least two grooves 108 are present. The grooves 108 are each disposed to receive a ring 110, such as an O-ring or seal ring to seal out moisture or a reinforcement ring to help anchor the form tie in the placed concrete. These rings are generally known in the art. The grooves 108 of the preferred embodiment are annular; however, grooves of any shape, such as a square notch, may be used. Although the grooves 108 and rings 110 may be of any size necessary for the application, in the preferred embodiment the groove 108 has a radius of approximately one-sixteenth inch, with the corresponding ring 110 fitting tightly therein.

In the case of sealing out moisture, the rings 110 guard against both hydraulic and gaseous moisture, which usually flow from warm to cool areas. Generally hydraulic moisture flow is an issue in below ground applications, whereas gaseous moisture flow is an issue in above ground applications. The grooves 108 and corresponding rings 110 may be located anywhere on the form tie 100 that will be included in the final building component product. However, in the preferred embodiment, the rings 110 are located in the area closest to the source of the liquid to keep it out. Generally, the flow of water in any given application will be in one direction. In the preferred embodiment, the rings 110 will not be flush with the surface of the finished product, but located at least one-half inch back from the surface and more preferably one to two inches from the surface of the completed building component. The rings 110 keep moisture out in poorly consolidated concrete in any desired location of the completed structure. In a concrete sandwich wall, the rings 110 may be located anywhere in the wall, including on either side of the insulation or even in the insulation itself. However, the rings 110 are preferably located in one or both of the two concrete wythes. The material of the ring 110 will change depending on the application, but should generally be chemically resistant. Alternatively, one or more rings 110 may be used to reinforce or anchor the form tie 100 in the concrete. These rings 110 will also be received by grooves 108 in the central body portion 102 of the form tie 100. The rings 110 help prevent the form tie 100 from slipping in the finished building component product.

The taper-ended form ties 100 of the present invention are generally for use in the vertical construction of building components, such as concrete walls and concrete sandwich walls, as well as in the construction of building foundations. These applications include cast-in-place construction, as well as any other concrete building component construction that requires use of a form assembly to manufacture the component. The taper-ended form ties 100 of the present invention have both tensile and compressive strength capacity. Moreover, the taper-ended form ties 100 of the present invention are made of a composite material that expands and contracts at the same rates as concrete. Generally, the ties 100 do not have load bearing properties in the completed building component structure, but may in unique applications without departing from the scope of the invention. Moreover, the taper-ended form ties 100 of the preferred embodiment are not hollow so as to provide the necessary properties. However, one of skill in the art will realize that the taper-ended form tie 100 may be hollow or solid as the application requires, provided the appropriate properties are present.

Figure 2:
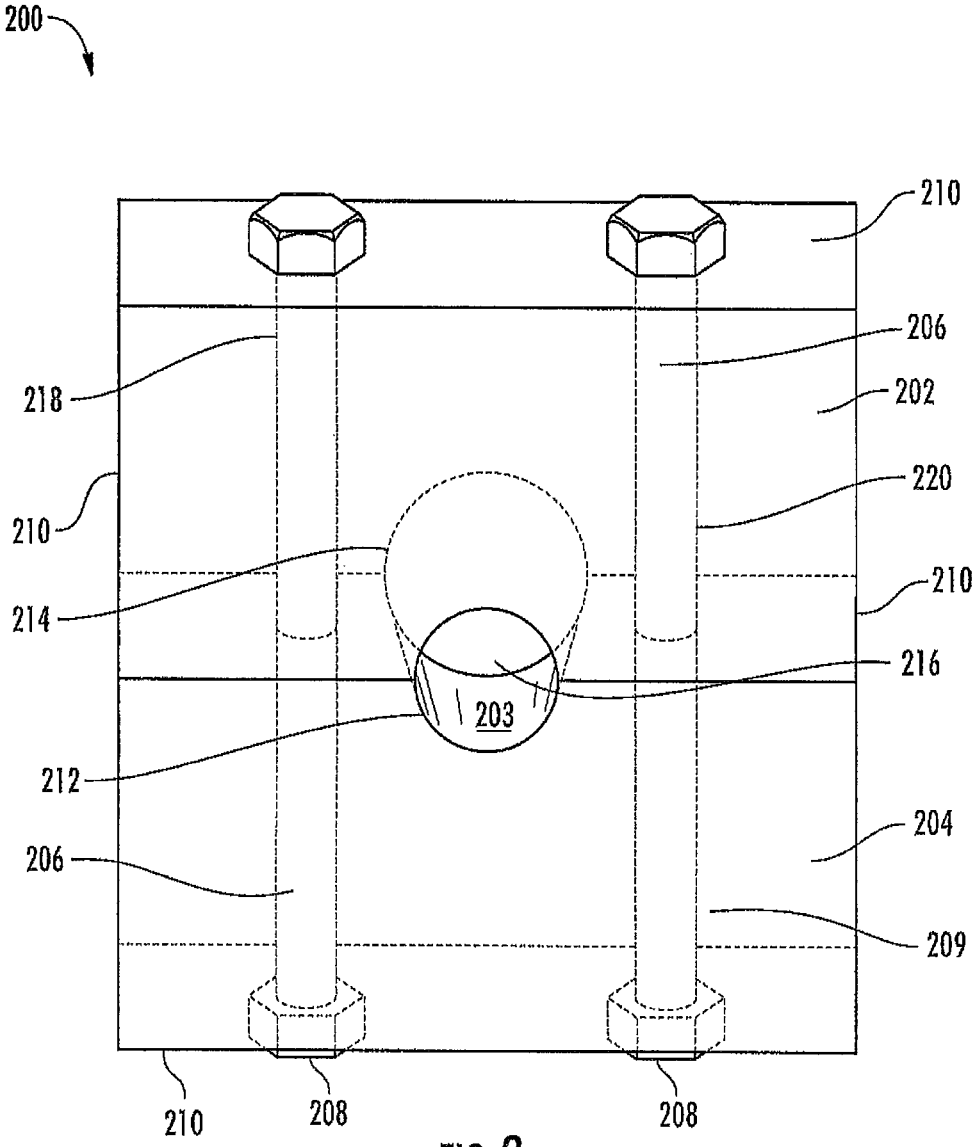
FIG. 2 is a perspective view according to one embodiment of a clamp device of the present invention.

Turning to FIG. 2, a clamp device 200 is shown. The clamp device 200 provides a means for releasably securing the form tie 100 in a form assembly 300. Specifically, the clamp device 200 attaches to either the first end portion 104 or second end portion 106 of the taper-ended form tie 100. To that end, the clamp device 200 includes a passageway 216 with a taper that is complimentary to one or both of the first taper 116 and second taper 122. In the preferred embodiment, a second clamp device 200 attaches to the other of the first end portion 104 or second end portion 106. However the necessity of a second clamp device 200 will depend on the application. The clamp device 200 of the preferred embodiment is made of steel, although any suitable material may be used without departing from the scope of the present invention. Moreover, it is anticipated that the clamp device 200 may be any shape capable of properly securing the form tie 100 in a form assembly 300.

As illustrated in FIG. 2, the preferred embodiment of the clamp device 200 includes a first clamp device member 202 and second clamp device member 204, which are separate parts that are joined to create the clamp device 200. One skilled in the art will recognize that the clamp device 200 may be made of any number of parts or members. The clamp device members 202, 204 align to create a continuous outer perimeter 210. The clamp device 200 further includes means to join the first clamp device member 202 and second clamp device member 204. Specifically, in the preferred embodiment, the clamp device 200 includes two screws or bolts 206 and two nuts 208 to join the two clamp device members together. One skilled in the art will recognize that any type and number of means may be employed to join and align the two clamp device members 202, 204.

Referring again to FIG. 2, the clamp device 200 includes a passageway 216 that extends all the way through the clamp device 200 and is defined by an passageway surface 203. The clamp device 200 further includes an proximal surface 209 and a distal surface 211 (shown in FIG. 6) that are each at an angle to the outer perimeter 210. The passageway 216 extends through both the proximal surface 209 and distal surface 211. Specifically, the passageway 216 comprises a proximal dimension 212 and a distal dimension 214. The proximal dimension 212 is located on the proximal surface 209 of the clamp device 200, and the distal dimension 214 is located on the distal surface 211 of the clamp device 200. The distal dimension 214 is greater than the proximal dimension 212. Accordingly, the passageway 216 decreases in dimension, or tapers, from the distal dimension 214 to the proximal dimension 212. This taper of the passageway 216 corresponds to the taper of the form tie 100 end portion 104 or 106 that the clamp device 200 will grip. Accordingly, the taper of the passageway 216 is generally at an angle of one to forty-five degrees, but preferably at an angle of four to seven degrees, and most preferably at an angle of four degrees.

Figure 3:
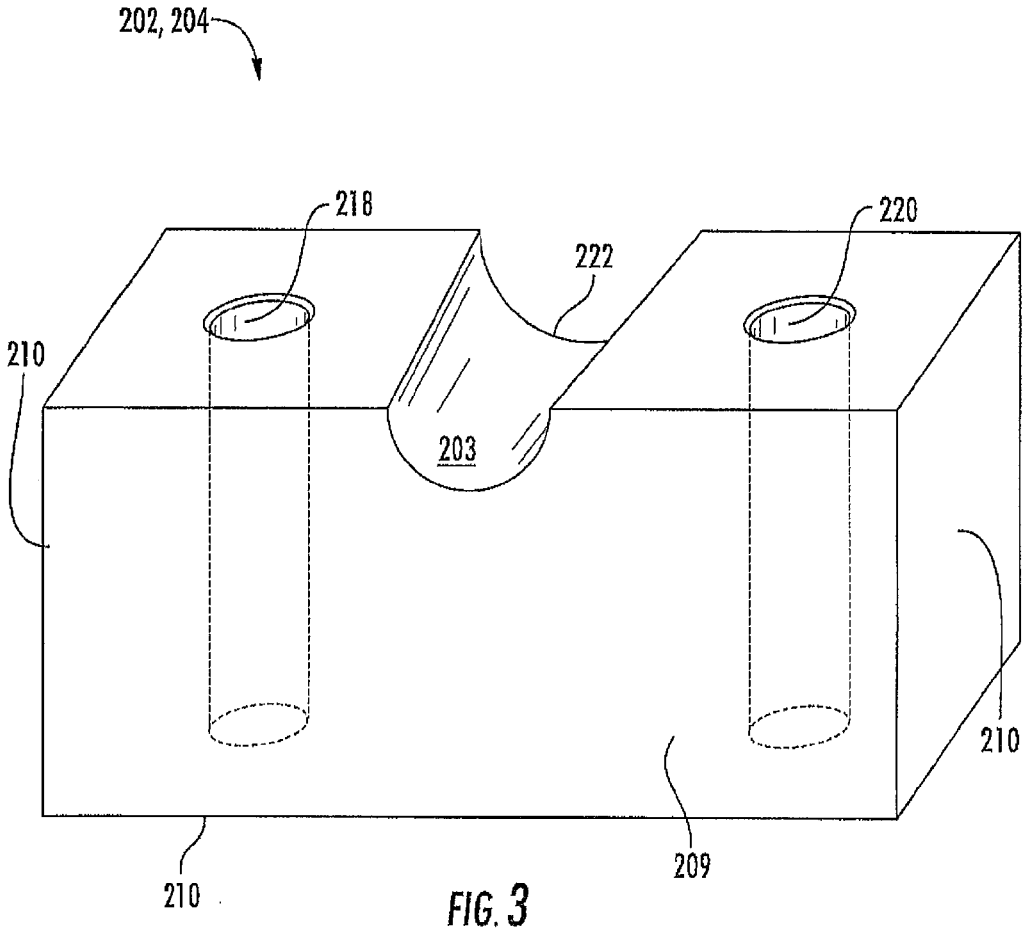
FIG. 3 is a perspective view of a clamp device member of the clamp device of FIG. 2.

Turning to FIG. 3, a clamp device member 202, 204 is shown. In the preferred embodiment, the clamp device members 202, 204 are identical. Accordingly, one clamp device member 202, 204 is shown in FIG. 3 to represent both clamp device members 202, 204. However, the clamp device members 202, 204, need not be identical. The clamp device member 202, 204 includes a first bore 218 and a second bore 220, that each receive a bolt 206 for joining and aligning the two clamp device members 202, 204. The first bore 218 and second bore 220 each extend all the way through the clamp device member 202, 204. As discussed above, the clamp device 200 may be made of any number of parts. When the clamp device 200 is made of more than one part, any means may be used to hold the parts together. Accordingly, while the preferred embodiment of the clamp device members 202, 204 include a first bore 218 and second bore 220 to receive a bolt 206, other embodiments of the clamp device 200 may not include these features. As illustrated in FIG. 3, each clamp device member 202, 204 includes a groove 222. The grooves 222 of the clamp device members 202, 204 align to create the passageway 216. The groove 222 is defined by the passageway surface 203 of the clamp device member 202, 204 and clamp device 200.

Figure 4:
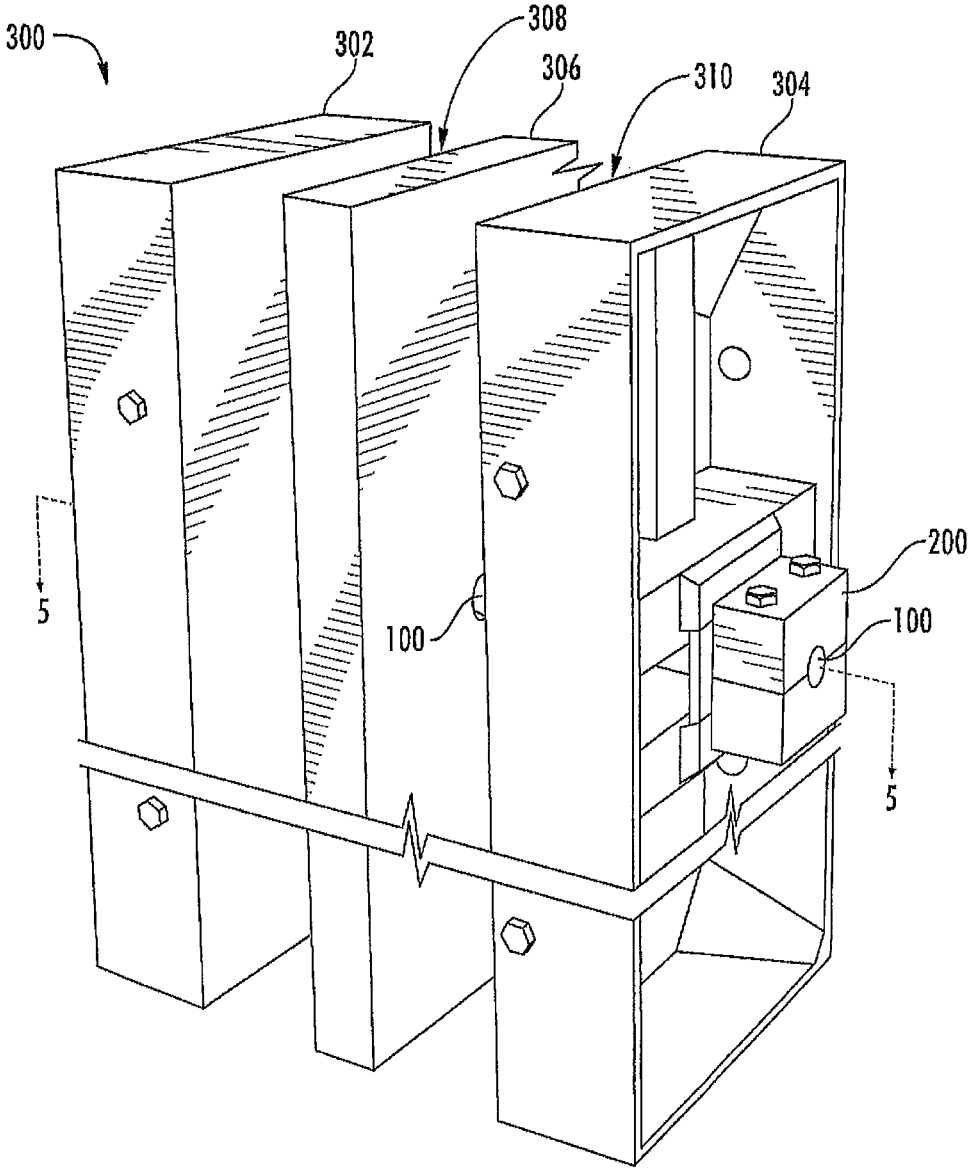
FIG. 4 is a perspective view according to one embodiment of a section of a form assembly of the present invention, including an assembled form tie of FIG. 1 and clamp device of FIG. 2.
Figure 5:
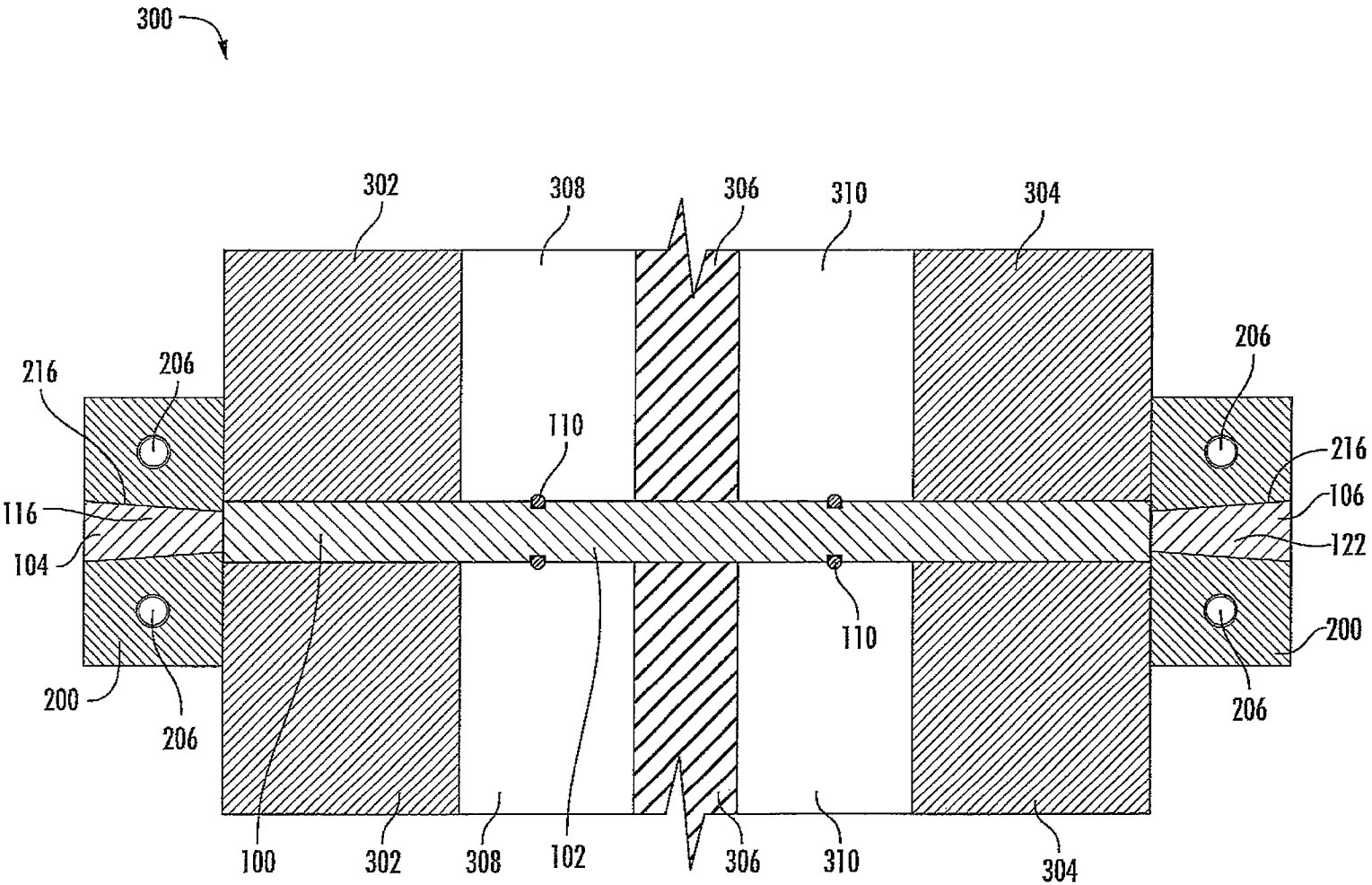
FIG. 5 is a cross-sectional view of the section of form assembly and assembled form tie and clamp device taken along lines 5-5 in FIG. 4.

A significant feature of the clamp device 200 is the tapered shape of the passageway 216. As load is applied to the form tie 100, the clamp device 200 tightens. Referring to FIGS. 4-5, this occurs as the concrete is placed into the form assembly 300. The plastic concrete exerts a force on the form walls 302, 304 such that it tries to push the form walls 302, 304 outward. This in turn pushes the clamp device 200 outward. Since the clamp device 200 passageway 216 tapers and must slide from the narrow inner end 112 or 118 to the wider outer end 114 or 120 of the taper tie 100, the first clamp device member 202 and second clamp device member 204 will try to separate, but the two bolts 206 and nuts 208 will hold the first clamp device member 202 and second clamp device member 204 tighter together until the capacity of the bolts 206 is reached. Larger diameter bolts 206 may be used to increase the strength capacity of the form tie 100.

Figure 6:
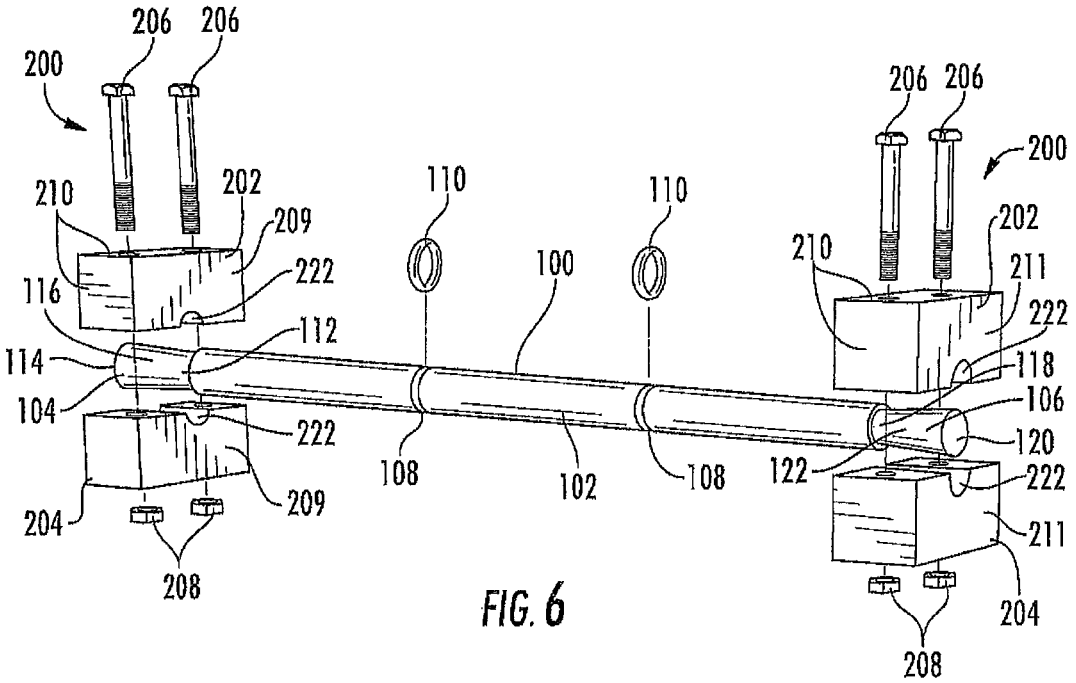
FIG. 6 is an exploded view of the assembled form tie and two clamp devices of FIG. 5.

As illustrated in FIGS. 4-6, the clamp device 200 tightly grips the form tie 100. Furthermore, the shape allows for greater strength capacity and reduces the chances of slippage or failure of the form tie. The clamp device 200 works similar to a wedge. As discussed above, the passageway 216 matches the taper 116 or 122 of the end portion 104 or 106 to which it will attach in a form assembly 300. The angling and wedge design of the form tie 100 and corresponding clamp device 200 provides for a greater strength capacity than form ties of the prior art. In the preferred embodiment, the tensile strength of the form tie 100 is 120,000 pounds per square inch. As discussed above, ties of the prior art are not able to take advantage of as much of the strength capacity of the form tie as possible. The first taper 116, second taper 122, and corresponding clamp device 200 passageway 216 take advantage of a greater portion of the strength capacity of the form tie 100 for use in the construction of building components, partly by providing a greater surface area for the clamp device 200 to grip. Accordingly, fewer form ties 100 of the present invention will need to be used in a given wall than form ties of the prior art, and form ties 100 of the present invention may be used in taller wall construction where the forces due to the plastic concrete are large. The angles and lengths of the first taper 116, second taper 122, and passageway 216 all contribute to the strength capacity of the form tie 100 and will vary from application to application. It is anticipated that the clamp device 200 may include further features to increase the strength of the grip between the clamp device 200 and form tie 100 without departing from the scope of the present invention. It is further anticipated that the user could attach the clamp device 200 to the form assembly 300 without departing from the scope of the present invention.

The taper-ended form tie 100 and clamp device 200 of the present invention are used in a form assembly 300 to construct building components, such as concrete building components including, but not limited to, concrete walls, concrete sandwich walls, and concrete foundations. Referring to FIG. 4, a section of a form assembly 300 for a concrete sandwich wall is shown. The form assembly 300 includes a first form wall 302 and a second form wall 304, which are known in the art and may be made of wood, aluminum, steel, or any other suitable material known now or in the future. As the form assembly of FIG. 4 is for construction of a sandwich wall, a piece of planar insulation board 306 is located between the first form wall 302 and second form wall 304. Planar insulation is known in the art and may include expanded or extruded polystyrene, polyisocyanurate, or any other suitable material known now or in the future. Located between the first form wall 302 and insulation 306 is a first space 308, and between the second form wall 304 and insulation 306 is a second space 310. Further included is at least one taper-ended form tie 100 of the present invention. As one of skill in the art will recognize, the number and thickness of taper-ended form ties 100 in the form assembly 300 will vary depending on may factors, including but not limited to the height and thickness of the wall, as well as the application. In the preferred embodiment, the form assembly 300 also includes at least one clamp device 200 of the present invention to releasably secure the form tie 100 to the form assembly 300. Once the form assembly 300 has been assembled, wet concrete will be placed in the first space 308 and second space 310. The form assembly 300 of the present invention may also include connectors and other types of ties without departing from the scope of the present invention.

As illustrated in FIGS. 4 and 5, the central body portion 102 of the taper-ended form tie 100 spans the first form wall 302, the first space 308, the planar insulation board 306, the second space 310, and the second form wall 304. The first end portion 104 extends beyond the first form wall 302, while the second end portion 106 extends beyond the second form wall 304. The taper-ended form tie 100 may be used with any form wall that is designed to take ties, with little to no modification. If modification is necessary, it can generally be made onsite. Alternatively, form walls can be used that are specifically made to fit with the taper-ended form tie 100 of the present invention. Importantly, the form walls 302, 304 must be able to be squared to each other to construct a proper end product. It is anticipated that the taper-ended form tie 100 or clamp device 200 may be used to assist in squaring the form assembly 300. The planar insulation board 306 may be predrilled with holes to accept the taper-ended form tie 100 or, more preferably, may be drilled onsite with a nylon cutter. Generally, the holes in the form walls 302, 304 and insulation 306 should be just large enough to accept the form ties 100. The form assembly 300 may also include a back-plate or square plate between the form walls 302, 304 and the clamp device 200, which can help carry the weight of the poured concrete.

Once the first form wall 302, second form wall 304, insulation 306, and at least one taper-ended form tie 100 have been assembled, the at least one form tie 100 is releasably secured in place using means for same. Preferably the means is the clamp device 200 discussed above. As illustrated by the exploded view of FIG. 6, the clamp device 200 is attached by placing the grooves 222 of the two clamp device members 202, 204 around a taper 116 or 122 of the form tie 100, and joining the two clamp device members 202, 204, such as with the two bolts 206 and nuts 208 discussed above. Again, the clamp device 200 may be made of any number of parts and joined by any means. Generally, one clamp device 200 is attached onto each end portion 104 and 106 of the form tie 100, although in some applications it may only be necessary to secure one end of the form tie 100 in the form assembly 300. As discussed above, the angle of the tapered portions 116, 122 of the form tie 100 correspond to the tapered passageway 216 of the clamp device 200 such that the form tie 100 and clamp device 200 fit tightly together. The tight grip caused by the angle of the form tie 100 and passageway 216 takes advantage of the strength capacity of the form tie 100.

After the first form wall 302, second form wall 304, planar insulation board 306, at least one form tie 100, and at least one clamp device 200 have been assembled to create the form assembly 300, concrete may be placed in the first space 308 and second space 310. Once the concrete has cured, the at least one clamp device 200, first form wall 302, and second form wall 304 are removed. The at least one taper-ended form tie 100 remains in the sandwich wall. As discussed above, the taper-ended form tie 100 is made of a composite material that is both non-corrosive and non-conductive. Accordingly, the form tie 100 prevents the previously mentioned problems associated with corrosion and conductivity during the lifetime of the completed product. Moreover, the form tie 100 may include at least one ring 110 to prevent issues with moisture and at least one reinforcement ring to anchor the form tie 100 in the concrete and prevent slippage. As discussed above, the form tie 100 of the present invention remains in the completed building component, which eliminates the need to fill holes left behind by form ties of the prior art. Rather, after the form walls 302, 304 have been removed, the portions of the form tie 100 that are left protruding from the sandwich wall are cut at the wall's surface, such as with a masonry saw or diamond saw. Alternatively, a specialty diamond saw designed specifically for this purpose may be used, which will leave a flat, smooth, even cut. The surface of the form tie 100 that remains visible can be sprayed with texture, stained, painted, or finished in any other way that concrete is finished.

FIG. 5 is a cross section of FIG. 4 taken along the lines 5-5. Shown are the first form wall 302, second form wall 304, planar insulation board 306, first space 308, and second space 310, with the taper-ended form tie 100 spanning all layers of the form assembly 300. Also shown are two clamp devices 200, one on each end portion 104, 106 of the form tie 100 and adjacent to the first form wall 302 and second form wall 304. The first taper 116 and second taper 122 fit snugly with the tapered passageways 216 of the clamp assembly. As discussed above, the tight grip of these components cooperate to take advantage of the strength capacity of the form tie 100.

In addition to a concrete sandwich panel, the form tie 100, clamp device 200, and form assembly 300 of the present invention may be used to create other building components, including but not limited to concrete walls and foundations. A form assembly 300 of the present invention for a concrete wall would be similar to the sandwich panel form assembly 300 shown in FIG. 4. However, as one of skill in the art will recognize, there would not be a piece of insulation 306 located between the form walls 302, 304, and only one space would be present for placing concrete. Accordingly, the form tie 100 would span the first form wall 302, one space, and the second form wall 304. Most foundation applications employing the form tie 100 and clamp device 200 of the present invention would be for commercial buildings, where the foundation is generally approximately twenty-four inches wide and from six to twenty-four feet deep. A form assembly for a foundation application would be constructed in much the same way as a concrete wall, with a first form wall 302, second form wall 304, and at least one form tie 100 and clamp device 200. It is anticipated that form assemblies 300 of the present invention will be of many different shapes and sizes as the application requires. Further, a form assembly 300 of the present invention may include cutouts, such as for doors or windows, without departing from the scope of the present invention.

Although various representative embodiments of this invention have been described above with a certain degree of particularity, those skilled in the art could make numerous alterations to the disclosed embodiments without departing from the spirit or scope of the inventive subject matter set forth in the specification and claims. Joinder references (e.g. attached, adhered, joined) are to be construed broadly and may include intermediate members between a connection of elements and relative movement between elements. As such, joinder references do not necessarily infer that two elements are directly connected and in fixed relation to each other. In some instances, in methodologies directly or indirectly set forth herein, various steps and operations are described in one possible order of operation, but those skilled in the art will recognize that steps and operations may be rearranged, replaced, or eliminated without necessarily departing from the spirit and scope of the present invention. It is intended that all matter contained in the above description or shown in the accompanying drawings shall be interpreted as illustrative only and not limiting. Changes in detail or structure may be made without departing from the spirit of the invention as defined in the appended claims.

Although the present invention has been described with reference to the embodiments outlined above, various alternatives, modifications, variations, improvements and/or substantial equivalents, whether known or that are or may be presently foreseen, may become apparent to those having at least ordinary skill in the art. Listing the steps of a method in a certain order does not constitute any limitation on the order of the steps of the method. Accordingly, the embodiments of the invention set forth above are intended to be illustrative, not limiting. Persons skilled in the art will recognize that changes may be made in form and detail without departing from the spirit and scope of the invention. Therefore, the invention is intended to embrace all known or earlier developed alternatives, modifications, variations, improvements, and/or substantial equivalents.

The invention claimed is:

1. A form tie comprising:
an elongated body portion;
a first end portion having a first width and a second width, wherein said second width is greater than said first width;
a second end portion having a first width and a second width, wherein said second width is greater than said first width;
said first end portion and second end portion extending in opposite directions from said body portion;
said first width of said first end portion located closer to said elongated body portion than said second width of said first end portion;
said first width of said second end portion located closer to said elongated body portion than said second width of said second end portion;
substantial portions of said first and second end portions tapering toward said elongated body portion;
at least one form wall contacting portion;
at least one groove located in said body portion; and
at least one ring received by said groove.

2. The form tie of claim 1 wherein said substantial portion of said first end portion is located opposite a first form wall from a second form wall and said substantial portion of said second end portion is located opposite said second form wall from said first form wall.

3. The form tie of claim 1 wherein the ring seals out moisture.

4. The form tie of claim 1 wherein the ring anchors the form tie in a concrete structure.

5. The form tie of claim 1 further comprising means for releasably securing said form tie in a form assembly.

6. The form tie of claim 5 wherein said means for releasably securing said form tie is a clamp device comprising a passageway wherein the profile and dimensions of said passageway correspond to one of the end portions of said form tie.

7. The form tie of claim 1 wherein the cross-sectional width of said body portion is between 0.5 and 2 inches.

8. The form tie of claim 1 wherein said substantial portions of said first and second end portions tapering toward said elongated body portion are at an angle between one and forty-five degrees.

9. The form tie of claim 1 wherein said substantial portions of said first and second end portions tapering toward said elongated body portion are at an angle between four and seven degrees.

10. The form tie of claim 1 wherein the entire outer surfaces of said first and second end portions corresponding to said substantial portions of said first and second end portions tapering toward said elongated body portion are tapered.

11. A form tie comprising:
an elongated body portion;
a first end portion having a first width and a second width, wherein said second width is greater than said first width;
a second end portion having a first width and a second width, wherein said second width is greater than said first width;
said first end portion and second end portion extending in opposite directions from said body portion;
said first with of said first end portion located closer to said elongated body portion than said second width of said first end portion;
said first width of said second end portion located closer to said elongated body portion than said second width of said second end portion;
substantial portions of said first and second end portions tapering toward said elongated body portion; and
at least one form will contacting portion;
wherein the width of said body portion, said second width of said first end portion, and said second width of said second end portion are equal.

12. A form assembly comprising:
a first form wall;
a second form wall; and
at least one form tie in communication with said first and second form walls comprising:
an elongated body portion;
a first end portion having a first width and a second width, wherein said second width is greater than said first width;
a second end portion having a first width and a second width, wherein said second width is greater than said first width;
said first end portion and second end portion extending in opposite directions from said body portion;
said first width of said first end portion located closer to said elongated body portion than said second width of said first end portion;
said first width of said second end portion located closer to said elongated body portion than said second width of said second end portion;
substantial portions of said first and second end portions tapering toward said elongated body portion; and
said substantial portion of said first end portion is located opposite said first form wall from said second form wall and said substantial portion of said second end portion is located opposite said second form assembly wall from said first form wall.

13. The form assembly of claim 12 further comprising at least one clamp device for releasably securing said form tie in said form assembly comprising a passageway wherein the profile and dimensions of said passageway correspond to one of the end portions of said form tie.

14. The form assembly of claim 12 further comprising a piece of planar insulation board located between said first form wall and said second form wall.

* * * * *